US008339429B2

(12) United States Patent
Canu et al.

(10) Patent No.: US 8,339,429 B2
(45) Date of Patent: Dec. 25, 2012

(54) DISPLAY MONITOR ELECTRIC POWER CONSUMPTION OPTIMIZATION

(75) Inventors: Marco Canu, Rome (IT); Sandro Piccinini, Rome (IT); Luigi Pichetti, Rome (IT); Marco Secchi, Rome (IT)

(73) Assignee: International Business Machines Corporation, Armonk, NY (US)

( * ) Notice: Subject to any disclaimer, the term of this patent is extended or adjusted under 35 U.S.C. 154(b) by 876 days.

(21) Appl. No.: 12/179,470

(22) Filed: Jul. 24, 2008

(65) Prior Publication Data

US 2010/0020092 A1 Jan. 28, 2010

(51) Int. Cl.
*G09G 5/02* (2006.01)

(52) U.S. Cl. ..... 345/698

(58) Field of Classification Search ..... 345/658
See application file for complete search history.

(56) References Cited

U.S. PATENT DOCUMENTS

| | | | | |
|---|---|---|---|---|
| 5,682,529 | A | 10/1997 | Hendry et al. | |
| 5,822,599 | A * | 10/1998 | Kidder et al. | 713/324 |
| 6,282,646 | B1 | 8/2001 | Hendry et al. | |
| 6,801,811 | B2 | 10/2004 | Ranganathan et al. | |
| 6,912,664 | B2 | 6/2005 | Ranganathan et al. | |
| 7,036,025 | B2 * | 4/2006 | Hunter | 713/300 |
| 7,196,700 | B1 | 3/2007 | Aho et al. | |
| 7,552,349 | B2 * | 6/2009 | Hassan et al. | 713/320 |
| 2006/0087502 | A1 * | 4/2006 | Karidis et al. | 345/211 |
| 2007/0057901 | A1 * | 3/2007 | Chino | 345/102 |
| 2007/0146266 | A1 | 6/2007 | Yasuda et al. | |
| 2008/0129760 | A1 * | 6/2008 | Phan | 345/690 |

* cited by examiner

*Primary Examiner* — Jeffrey Chow
(74) *Attorney, Agent, or Firm* — DeLizio Gilliam, PLLC

(57) ABSTRACT

Controlling electrical power consumption of a display monitor screen involves grouping screen pixels into different resolution cells, detecting display of one or more windows on the screen, and selectively controlling the cells by providing power only to the pixels in cells corresponding to one or more windows of interest to the user, and reducing power to pixels in remaining cells.

13 Claims, 4 Drawing Sheets

DISPLAY MONITOR ELECTRIC POWER CONSUMPTION OPTIMIZATION

BACKGROUND OF THE INVENTION

1. Field of the Invention

The present invention relates generally to electric power consumption control and in particular to electric power consumption control in electronic display monitors.

2. Background Information

With the proliferation of computing and consumer electronics systems, the amount of electrical power consumed by such systems is on the rise. One component of such systems that consumes a significant amount of electrical power is the display monitor. The amount of electrical power consumed by an LCD or CRT monitor is not trivial compared to other computer components. For example, in case of personal computers such as notebook/laptop computers, the most power consuming component is the display monitor.

High resolution and high brightness display monitors consume more power than lower resolution/brightness display monitors. Higher resolution/brightness display monitors lead to a battery life reduction up to 30 percent compared to lower resolution/brightness display monitors. To conserve power, typically when using a notebook computer on battery power, users turn down the display monitor brightness in order to lengthen battery life of the notebook computer. For higher resolution display monitors, the user must either reduce resolution on the notebook computer for a longer battery life, or utilize the display monitor at best resolution but with a shorter battery life. In addition to notebook computers, other devices with display monitors (desktop computers, servers, workstations, etc.) experience the same power consumption issues. This is crucial for many organizations in terms of reducing energy consumed by their computing equipment.

SUMMARY OF THE INVENTION

The invention provides a method and system for controlling electrical power consumption of a display monitor screen. One embodiment includes grouping screen pixels into different resolution cells, detecting display of one or more windows on the screen, and selectively controlling the cells by providing power only to the pixels in cells corresponding to one or more windows of interest to the user, and reducing power to pixels in remaining cells.

Grouping screen pixels into different resolution cells may include grouping screen pixels into different nested resolution cells. Selectively controlling the cells may include selectively powering on only the pixels in cells corresponding to one or more windows of interest to the user, and powering off pixels remaining cells. Selectively controlling the cells may further include selectively providing power for backlighting only the cells corresponding to one or more windows of interest to the user, and reducing power for backlighting remaining cells.

Selectively controlling the cells may include dynamically providing power on only the pixels in cells corresponding to one or more windows of interest to the user, and reducing power to pixels in remaining cells. Detecting display of one or more windows on the screen may further include detecting a window of interest to the user based on user interaction. Detecting display of one or more windows on the screen may further include detecting a window of interest to the user based on operating system feedback.

Other aspects and advantages of the present invention will become apparent from the following detailed description, which, when taken in conjunction with the drawings, illustrate by way of example the principles of the invention.

BRIEF DESCRIPTION OF THE DRAWINGS

For a fuller understanding of the nature and advantages of the invention, as well as a preferred mode of use, reference should be made to the following detailed description read in conjunction with the accompanying drawings, in which.

DESCRIPTION OF THE PREFERRED EMBODIMENTS

The following description is made for the purpose of illustrating the general principles of the invention and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

The invention provides a method and system for display monitor electric power consumption optimization. One embodiment involves optimizing usage of display monitors in term of user experience, battery performance and energy savings. Optimization herein may include reducing or minimizing power consumed by a display monitor in operation.

Often a user is only interested in (focused on) information in one or a few sections of the display monitor screen area at a time (e.g., section(s) of the display screen that are actually used). The user is not generally interested in having the remaining sections of the display screen with best appearance. An embodiment of the invention provides selective activation of one or more sections of the display monitor, leaving other sections in power saving mode (e.g., turned off, lower brightness/resolution).

Figure 1:
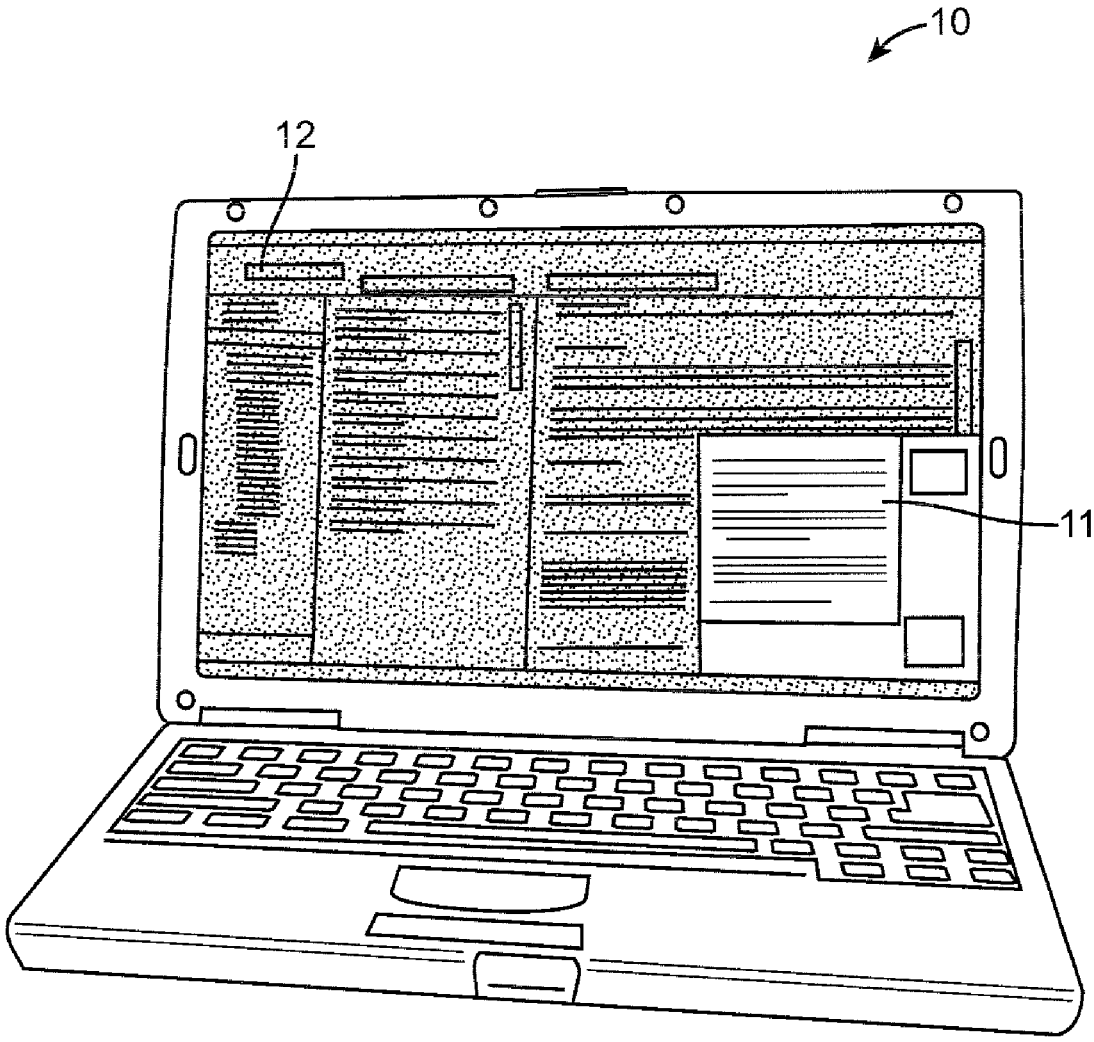
FIG. 1 shows a graphical example of power consumption optimization of a display screen, according to an embodiment of the invention.

Referring to FIG. 1, for an LCD display monitor 10, according to an embodiment of the invention, a management system provides power saving by selectively activating (polarizing) only the pixels of section(s) of interest 11, thereby saving energy consumed by the pixels on other sections 12 (pixels of other sections remain inactive, resulting in power saving). The management system further reduces power consumed for backlighting on the LCD display monitor by selectively controlling display such as allowing backlighting for the section(s) of interest, while leaving other sections darker.

Figure 2:
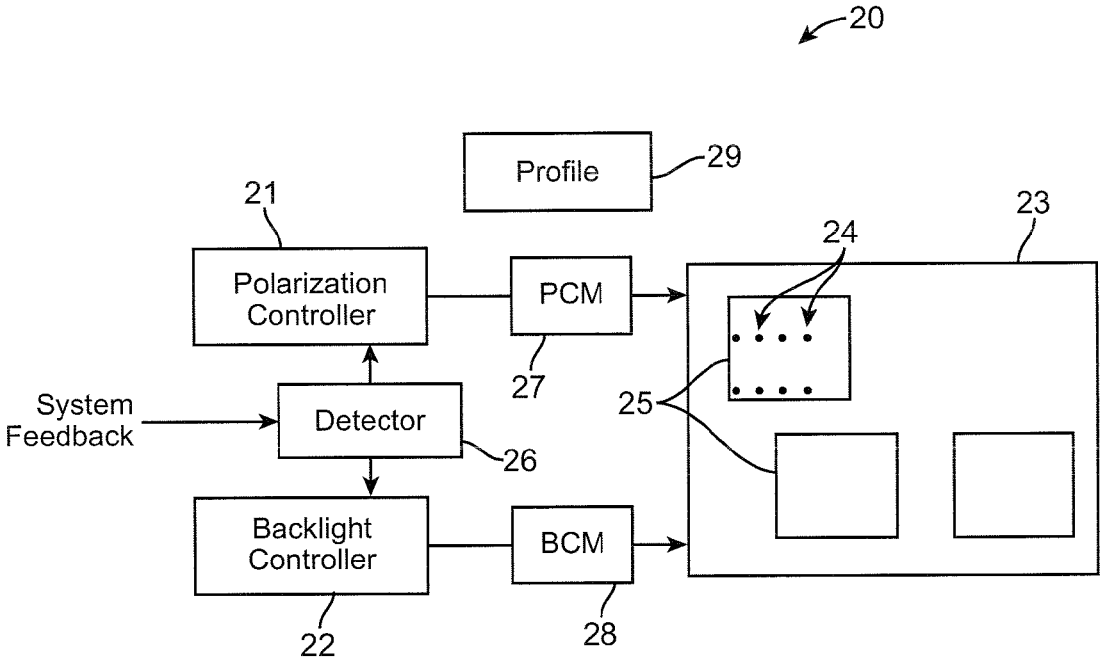
FIG. 2 shows a functional block diagram of a power management system for power consumption optimization of a display screen, according to an embodiment of the invention.
Figure 3:
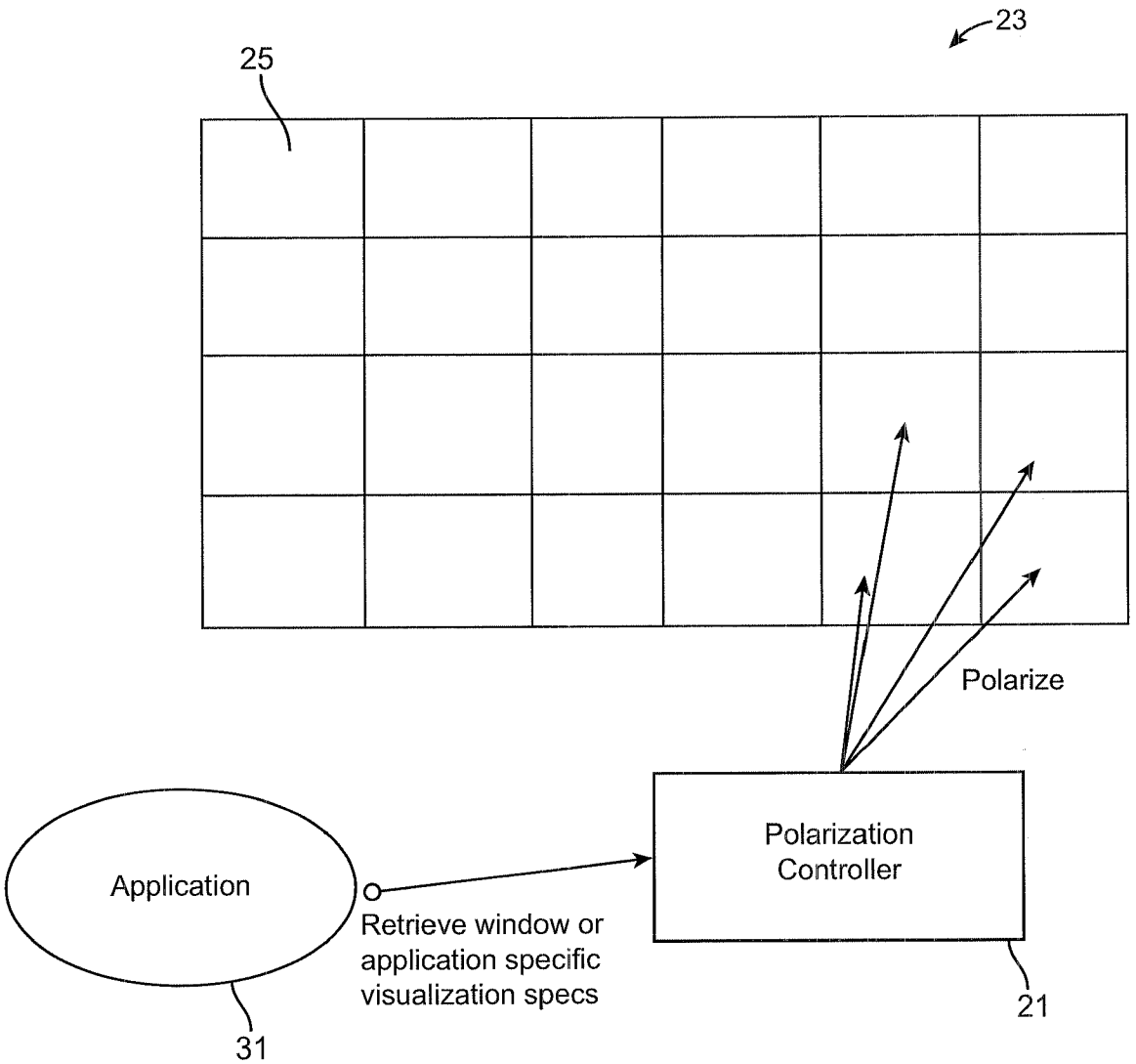
FIG. 3 shows a graphical example of power consumption optimization of display screen cells, according to an embodiment of the invention.

FIG. 2 shows a functional block diagram of an embodiment of such a management system 20. The management system 20 includes a polarization controller 21 and a backlight controller 22. The polarization controller 21 is configured for selective pixel polarization for a LCD display screen 23. The backlight controller 22 is configured for selective backlight activation for the display screen 23. The display screen 23 is managed according to a nested structure. The pixels 24 are grouped in nested cells (units) 25 that are activated together. The display screen 23 is organized as nested cells 25 of selected resolutions. The cells are positioned on the screen as shown in FIG. 3 as a grid that may have different granularity. A screen of 100×100 cells can have a smaller capability of power saving than a 1000×1000 cell screen since in the first case overlapping of windows to be polarized and underlying grid can require a cell to be polarized even if the screen window requires only a portion of that cell (since the window overlaps that cell partially). Preferably, the number of cells may be determined at implementation time on a power saving vs. cost.

For example, a display screen with the overall resolution of 1400×1050 pixels can comprise four different nested, sub-resolution, cells 25 such as: 1280×1024, 1024×768, 800×600 and 640×480 cells. Nested cells can be implemented in different ways, such as 1400×1050 resolution containing a 1280×1024 resolution, and so on. This allows activating at least one cell of the display screen at a time. The cells represent screen itself, such that any windows to be polarized depending on size will require polarizing a subset of the screen cells. Consider for example a screen made of n cells, wherein each window requires m cells to be polarized with m<=n. The case where m=n is the case when a window is in full screen mode. Similarly, the backlight controller increases brightness of only the nested cells that are in actual use by the user.

The controllers 21, 22, implement grouping of the grouping of screen pixels into different resolution cells, and the detector 26 detects display of one or more windows on the screen. The controller 21 performs selectively controlling the cells by providing power only to the pixels in cells corresponding to one or more windows of interest to the user, and reducing power to pixels in remaining cells. The controller 22 performs selectively providing power for backlighting only the cells corresponding to one or more windows of interest to the user, and reducing power for backlighting remaining cells.

FIG. 3 shows another example of the screen cell structure. The screen 23 includes multiple nested cells 25 that can be polarized independently. A user provides a power saving specification profile 29 (FIG. 2). For example the user may want only the window having focus (or the first n) or the actual running (CPU or memory based) application window (s) to be polarized. That specification is applied such that when a detector 26 of the management system determines a change in any of the windows (e.g., based on feedback from the system, user interaction, etc.), the polarization controller 21 checks the profile and applies the profiled power saving specification. If the user switches to a target window with a resolution lower than the display resolution the polarization controller adjusts the system resolution to that of the target window. If based on input from the detector 26 the polarization controller 21 determines that there is no activity on the display screen, then a lower visualization mode (or no visualization) is applied. A window may be, for example, an application window in a graphical user interface functioning on a multitasking operating system such as Microsoft Windows, wherein multiple applications are depicted by multiple windows on the display screen. The polarization controller retrieves window or application specific visualization specifications for adjusting the resolution of a window corresponding to an application 31.

Further, users are enabled to specify a change of resolution in relation to the actual use of the monitor. Such information may be saved in a user profile for each user. In one embodiment, the management system uses such information to automatically determine the actual use of various screen sections by the user and optimize the used section(s). For example, a user interested in browsing the web may not require a screen resolution higher than 1024×760 (the size most web sites are optimized to use). In this case, the management system reduces screen resolution based on such use, saving up to e.g., 40 percent of energy consumption by the display screen.

The management system may also be statically implemented regardless of user profile settings. For example, when projecting the monitor screen using a video beam, generally the resolution of display screen is greater than the one of video beam, wherein the common behavior is a reduction of the portion of the display screen that is powered.

As noted, the management system may optimize power usage (e.g., optimize screen resolution via the polarization controller) based on actual use of the display monitor. In another example, the management system may optimize power usage based on the multiple windows generically opened during a common usage of a personal computer.

Figure 4:
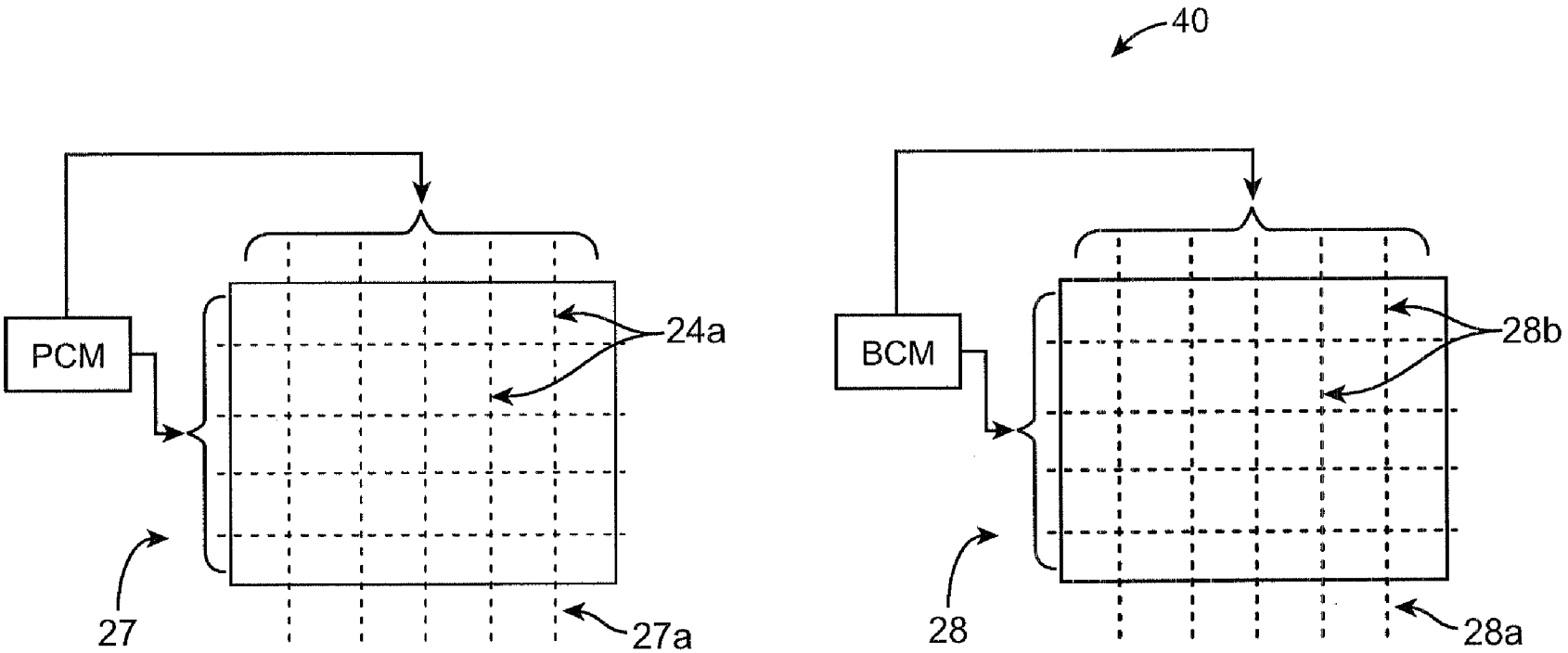
FIG. 4 shows a functional block diagram of a pixel and backlighting power management, according to an embodiment of the invention.

The display monitor may include a pixel control module (PCM) 27 (FIG. 2) wherein all screen pixels (or at least a reasonable group of pixels, for example, corresponding to a square centimeter) may be individually polarized by the polarization controller. As shown by the example screen structure 40 in FIG. 4, such a module 27 may include a control array 27*a* including a two dimensional matrix of control switches 24*a* corresponding to pixels 24, allowing control of intensity of each pixel. Similarly, a backlighting module 28 (e.g., LED backlighting) allows control of one or more LEDs for controlling backlighting intensity of different screen sections or portions thereof. As shown by the example screen structure 40 in FIG. 4 such a module 28 may comprise a control array 28*a* including a two dimensional matrix of control switches 28*b* corresponding to backlighting LEDs, allowing control of intensity of each LED.

As such, the management system can "follow" the user activity and optimizing winnow pixels that are currently used by the user, hereby reducing power consumption since others portions of windows out of the main activity are snowed with a lower brightness and resolution. The management approach may be associated to a specific power schema that can be customized by the user, for example, setting if and how the system should apply power saving. Such a schema may for example specify that last n used windows should remain power optimized, or that windows associated to specific application must always be power optimized, and so on. As such, the management system may associate a specific power schema that can be customized by the user to behave in specific ways.

The controllers 21, 22 and the detector 26 may comprise pluggable components for application in order to exchange information with the operating system and adjust screen resolution based on "best resolution for application", and further provide dynamic switching between resolutions. A dynamic adaptive approach to reduce power screen consumption energy adapts resolution of each screen section to that supported by that application displayed in that section. The management system may dynamically link appearance of a window (screen section) to the usage thereof. The usage of a window can overcome/collaborate with a screensaver in order to adapt power consumption based on a defined profile.

The management system leverages information about execution of each application to change resolution/backlighting of a screen section associated with each application to reduce power consumption. The management system adapts (adjusts) system display settings or system settings to conserve power, leveraging, for example, the fact that a specific application requires a lower display resolution.

As is known to those skilled in the art, the aforementioned example embodiments described above, according to the present invention, can be implemented in many ways, such as program instructions for execution by a processor, as software modules, as computer program product on computer readable media, as logic circuits, as silicon wafers, as integrated circuits, as application specific integrated circuits, as firmware, etc. Though the present invention has been described with reference to certain versions thereof; however, other versions are possible. Therefore, the spirit and scope of the appended claims should not be limited to the description of the preferred versions contained herein.

The terms "computer program medium," "computer usable medium," and "computer readable medium", "computer program product," are used to generally refer to media such main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Furthermore, the computer readable medium may comprise computer readable information in a transitory state medium such as a network link and/or a network interface, including a wired network or a wireless network, that allow a computer to read such computer readable information. Computer programs (also called computer control logic) are stored in main memory and/or secondary memory. Computer programs may also be received via a communications interface. Such computer programs, when executed, enable the computer system to perform the features of the present invention as discussed herein. In particular, the computer programs, when executed, enable the processor multi-core processor to perform the features of the computer system. Accordingly, such computer programs represent controllers of the computer system.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A method for controlling electrical power consumption of a monolithic display monitor screen, comprising:

grouping screen pixels of the monolithic display monitor screen into different nested resolution cells;

detecting display of one or more windows on the monolithic display monitor screen; and selectively controlling the nested resolution cells, wherein selectively controlling the nested resolution cells comprises, dynamically identifying an optimal resolution of an application corresponding to a window of the one or more windows of interest, wherein the optimal resolution of the application is different than a maximum resolution of the monolithic display; and dynamically restricting a display of the window within one or more of the nested resolution cells corresponding to the optimal resolution without changing resolution of portions of the monolithic display not occupied by the window, wherein the one or more nested resolution cells within which the window is restricted is a subset of the nested resolution cells of the monolithic display;

providing power only to screen pixels in nested resolution cells corresponding to one or more windows of interest of the one or more windows on the monolithic display monitor screen to a user, and reducing power to screen pixels in remaining cells of the nested resolution cells, and selectively providing power for backlighting only the nested resolution cells corresponding to the one or more windows of interest of the one or more windows on the monolithic display monitor screen to the user, and reducing power for backlighting the remaining cells.

2. The method of claim 1 wherein selectively controlling the nested resolution cells includes selectively powering on only pixels in cells corresponding to one or more windows of interest to the user, and powering off pixels in remaining cells.

3. The method of claim 1 wherein detecting display of one or more windows on the monolithic display monitor screen further includes detecting a window of interest to the user based on user interaction.

4. The method of claim 1 wherein detecting display of one or more windows on the monolithic display monitor screen further includes detecting a window of interest to the user based on operating system feedback.

5. An apparatus for controlling electrical power consumption of a monolithic display monitor screen, comprising:

a power controller configured to control screen pixels grouped into different nested resolution cells;

a detector configured for detecting display of one or more windows on the monolithic display monitor screen; and a polarization controller configured to, dynamically identify an optimal resolution of an application corresponding to a window of the one or more windows of interest, wherein the optimal resolution of the application is different than a maximum resolution of the monolithic display; and dynamically restrict a display of the window within one or more of the nested resolution cells corresponding to the optimal resolution without changing resolution of portions of the monolithic display not occupied by the window, wherein the one or more nested resolution cells within which the window is restricted is a subset of the nested resolution cells of the monolithic display; control screen pixels grouped into different nested resolution cells;

wherein the power controller is further configured to selectively control the nested resolution cells, wherein the power controller being configured to selectively control the nested resolution cells comprises the power controller being configured to, provide power to only the screen pixels in nested resolution cells corresponding to one or more windows of interest of the one or more windows on the monolithic display monitor screen to a user, and reduce power to screen pixels in remaining cells of the nested resolution cells, and provide power for backlighting only the nested resolution cells corresponding the to one or more windows of interest of the one or more windows on the monolithic display monitor screen to the user, and reduce power for backlighting the remaining cells.

6. The apparatus of claim 5 wherein the power controller includes a pixel controller configured to selectively power on only pixels in cells corresponding to one or more windows of interest to the user, and power off pixels in remaining cells.

7. The apparatus of claim 6 wherein the power controller includes a backlighting controller configured to selectively provide power for backlighting only cells corresponding to one or more windows of interest to the user, and reduce power for backlighting remaining cells.

8. The apparatus of claim 5 wherein the detector is further configured for detecting a window of interest to the user based on user interaction.

9. The apparatus of claim 5 wherein the detector is further configured for detecting display of one or more windows on the monolithic display monitor screen as windows of interest based on operating system feedback.

10. A display system, comprising:

a monolithic display monitor screen having power controllable pixels;

a power controller configured to control pixels grouped into different nested resolution cells; and a detector configured to detect display of one or more windows on the monolithic display monitor screen; and a polarization controller configured to, dynamically identify an optimal resolution of an application corresponding to a window of the one or more windows of interest, wherein the optimal resolution of the application is different than a maximum resolution of the monolithic display; and dynamically restrict a display of the window within one or more of the nested resolution cells corresponding to the optimal resolution without changing resolution of portions of the monolithic display not occupied by the window, wherein the one or more nested resolution cells within which the window is restricted is a subset of the nested resolution cells of the monolithic display; control screen pixels grouped into different nested resolution cells wherein the power controller is further configured to selectively control the nested resolution cells, wherein the power controller being configured to selectively control the nested resolution cells comprises the power controller being configured to, provide power to only the power controllable pixels in nested resolution cells corresponding to one or more windows of the one or more windows on the monolithic display monitor screen of interest to a user, and reduce power to power controllable pixels in remaining cells of the nested resolution cells, and provide power for backlighting only the nested resolution cells corresponding to the one or more windows of interest of the one or more windows on the monolithic display monitor screen to the user, and reduce power for backlighting the remaining cells.

11. The system of claim 10 wherein the power controller includes a pixel controller configured to selectively power on only pixels in cells corresponding to one or more windows of interest to the user, and power off pixels in remaining cells.

12. The system of claim 10 wherein the power controller includes a backlighting controller configured to selectively provide power for backlighting only cells corresponding to one or more windows of interest to the user, and reduce power for backlighting remaining cells.

13. The system of claim 10 wherein the detector is further configured for:

detecting a window of interest to the user based on user interaction, and detecting display of one or more windows on the monolithic display monitor screen as windows of interest based on operating system feedback.

* * * * *